US005582404A

United States Patent [19]

Parzino

[11] Patent Number: 5,582,404

[45] Date of Patent: Dec. 10, 1996

[54] GOAL TENDER APPARATUS HAVING AUTOMATICALLY VARIABLE SPATIAL ORIENTATION

[76] Inventor: James P. Parzino, 128-12th Ave., Kirkland, Wash. 98033

[21] Appl. No.: 638,845

[22] Filed: Apr. 29, 1996

[51] Int. Cl.[6] ..... A63B 69/00

[52] U.S. Cl. ..... 273/57.2

[58] Field of Search ..... 273/57.2

[56] References Cited

U.S. PATENT DOCUMENTS

| | | | |
|---|---|---|---|
| 3,765,675 | 10/1973 | DiMarzio | 273/57.2 |
| 3,840,228 | 10/1974 | Greaney | 273/57.2 |
| 3,856,298 | 12/1974 | Frantti | 273/57.2 |
| 3,887,181 | 6/1975 | Samaras | 273/57.2 |
| 4,168,062 | 9/1979 | McCarthy et al. | 273/57.2 |
| 4,489,940 | 12/1984 | Amundson | 273/57.2 |
| 4,492,380 | 1/1985 | Saytar | 273/411 |
| 5,238,243 | 8/1993 | Grispi | 273/57.2 |
| 5,246,229 | 9/1993 | Carey | 273/57.2 X |
| 5,498,000 | 3/1996 | Cuneo | 273/57.2 X |
| 5,509,650 | 4/1996 | MacDonald | 273/57.2 X |

*Primary Examiner*—William H. Grieb

*Attorney, Agent, or Firm*—Christensen O'Connor; Johnson & Kindness PLLC

[57] ABSTRACT

A goal tender apparatus comprises a goal tender body having a lower end and a longitudinal axis with an upper portion and a lower portion is disclosed. An upper attachment device pivotally attaches the goal tender body to an upper crossbar of a goal adjacent the upper portion of the longitudinal axis of the goal tender body, a lower attachment device pivotally attaches the goal tender body to side posts of a goal adjacent the lower portion of the longitudinal axis of the goal tender body, and rollers are located on the lower end of the goal tender body. A motor provides a force substantially perpendicular to the longitudinal axis of the goal tender body, and the upper attachment device, the lower attachment device and the rollers to convert the substantially perpendicular force of the motor into arcuate movement of the goal tender body in front of a goal.

15 Claims, 6 Drawing Sheets

GOAL TENDER APPARATUS HAVING AUTOMATICALLY VARIABLE SPATIAL ORIENTATION

BACKGROUND OF THE INVENTION

The invention pertains to goal tender apparatuses, and more specifically to mechanical goal tender apparatuses which move with respect to the goal.

The prior art discloses numerous goal tender apparatuses, both movable and stationary. U.S. Pat. No. 3,765,675 discloses a simulated hockey goalie that is suspended from a threaded collar or a feed screw that rotates first in one direction and then the other to move the simulated hockey goalie linearly across the mouth of a hockey goal from one side to the other. A continuous belt beneath the goal and the goalie that forms part of the surface upon which a puck may slide transfers expended pucks in and around the goal into a puck-receiving receptacle.

U. S. Pat. No. 4,168,062 teaches an automated goalie having a pair of arms pivotally connected to a goalie body and movable between a substantially vertical lower position adjacent the goalie body and an upper position outwardly extending from the goalie body.

U.S. Pat. No. 4,492,380 discloses a game apparatus that can be used for hockey comprising a goal assembly with a net having target holes, and pockets for retaining successful shots.

U.S. Pat. No. 3,840,228 teaches a device for hockey practice that is forwardly disposed in a V-shaped configuration in front of a hockey goal whereby pucks striking the device are diverted to either side thereof. The device has apertures therethrough simulating the opening between the legs of a player and a pocket therein for receiving and holding a puck, simulating the catching of a puck by a player.

U.S. Pat. No. 3,856,298 discloses a hockey practice apparatus including a barricade suitable for attachment to the forward portion of a hockey goal, the barricade having one or more openings through which a puck may pass.

U.S. Pat. No. 3,887,181 discloses a goal shield having a frame defining a goal opening and a plurality of readily attachable and detachable panels that cooperate to form a goal shield. A plurality of fasteners are provided on the frame and adjacent sides of the panels for interlocking the panels and the frame. Selected panels are removed by disengaging certain fasteners to form random target areas in different locations in the goal opening. Plates are rotatably mounted to the panels through holes formed in the panels, such that additional target areas are provided when the plates are rotated to expose the holes.

U.S. Pat. No. 4,489,940 discloses a practice goal tender having a life-size silhouette figure mounted on a movable support base that includes a rigid board undersurface attached to a base support stand, a resilient overlayer outwardly covering the support surface, and an outer covering over the entire resilient layer and partially compressing the resilient layer against the board surface. A hinge attachment between the board structure and the board support stand may be present, and removable braces between the base support stand and the rear of the board structure may also be included.

U.S. Pat. No. 5,238,243 discloses a hockey target apparatus that includes a vertical board having a plurality of openings. The openings are directed through the board into a receiving net cage rearwardly of the vertical board. A counter mechanism is also included whereupon projection of a puck through one of the openings actuates a counter mechanism mounted to a side portion of the vertical board.

U.S. Pat. No. 5,246,229 discloses a street hockey apparatus comprised of a goal having a tubular frame with a net for catching a hockey ball, the silhouette of a goal tender mounted at the goal frame opening, and a slanting floor panel for returning a ball caught by the net.

Thus, it is readily apparent that the majority of the prior art practice goal tenders are stationary, and those that do provide motion either provide motion of only a portion of the goal tender, i.e., the arms, or provide unnatural linear motion across the goal mouth to which human goal tenders are generally not limited.

A need thus exists for a mechanical goal tender providing realistic motion for ice hockey or street hockey practice, or game play in which none of the human participants have to tend goal and which is portable, highly durable, mechanical, and lightweight.

A need further exists for the above type of mechanical goal tender apparatus in which the goal tender body has a longitudinal axis to which is attached an upper attachment device that pivotally attaches the goal tender body to the upper crossbar of a goal.

A further need exists for the above type of goal tender apparatus which also includes a lower attachment device that pivotally attaches the goal tender body to side posts of the goal.

An additional need exists for the above type of goal tender apparatus in which rollers are present on the lower end of the goal tender body to allow arcuate movement of the goal tender body.

An additional need exists for the above type of goal tender apparatus in which a motor provides a force substantially perpendicular to the longitudinal axis of the goal tender body, and the upper attachment device, lower attachment device and rollers convert the substantially perpendicular force from the motor into an arcuate movement of the goal tender body in front of the goal.

A further need exists for the above type of goal tender device that can be placed on goals of varying heights where the upper attachment device includes a hook reciprocatable within a shaft to vary the effective length of the shaft and hook combination.

A further need exits for the above type of mechanical goal tender apparatus in which the goal tender body includes an arm portion having netting on an end thereof in order to simulate goal tender saves realistically.

SUMMARY OF THE INVENTION

A goal tender apparatus comprises a goal tender body having a lower end and a longitudinal axis with an upper portion and a lower portion is disclosed. An upper attachment device pivotally attaches the goal tender body to an upper crossbar of a goal adjacent the upper portion of the longitudinal axis of the goal tender body, a lower attachment device pivotally attaches the goal tender body to side posts of a goal adjacent the lower portion of the longitudinal axis of the goal tender body, and rollers are located on the lower end of the goal tender body. A motor provides a force substantially perpendicular to the longitudinal axis of the goal tender body, and the upper attachment device, the lower attachment device and the rollers to convert the substantially perpendicular force of the motor into arcuate movement of the goal tender body in front of a goal.

The longitudinal axis of the goal tender apparatus is most preferably defined by a longitudinal shaft attached to the goal tender body. Preferably, the upper attachment device is comprised of a hook on an upper end of the longitudinal shaft which is adapted to be removably attached to an upper crossbar of a goal and is reciprocatable with respect to the longitudinal shaft such that the goal tender body is attachable to goals of different heights, a motor shaft attachment arm connected to and substantially perpendicular to the longitudinal shaft, an elastomer attachment device on a lower end of the longitudinal shaft, and an elastomer connected to the hook and the elastomer attachment device such that a portion of the mass of the goal tender body is offset by force from the elastomer to decrease the frictional force between the goal tender body and the ground that the motor must overcome.

In addition, the lower attachment device is preferably comprised of a plurality of elastomers connected between the lower portion of the longitudinal axis of the goal tender body and side posts of a goal to provide self centering resistance to the arcuate movement imparted to the goal tender body by the motor.

Most preferably, the motor has a cam rotatable by the motor and a shaft having a first end attached to the cam and a second end attached to the upper portion of the longitudinal axis of the goal tender body. The goal tender body preferably has an arm portion with netting on an end thereof.

BRIEF DESCRIPTION OF THE DRAWINGS

These and other features of the present invention will be more fully appreciated when considered in light of the following specification and drawings in which.

DETAILED DESCRIPTION OF THE PREFERRED EMBODIMENTS

Figure 1:
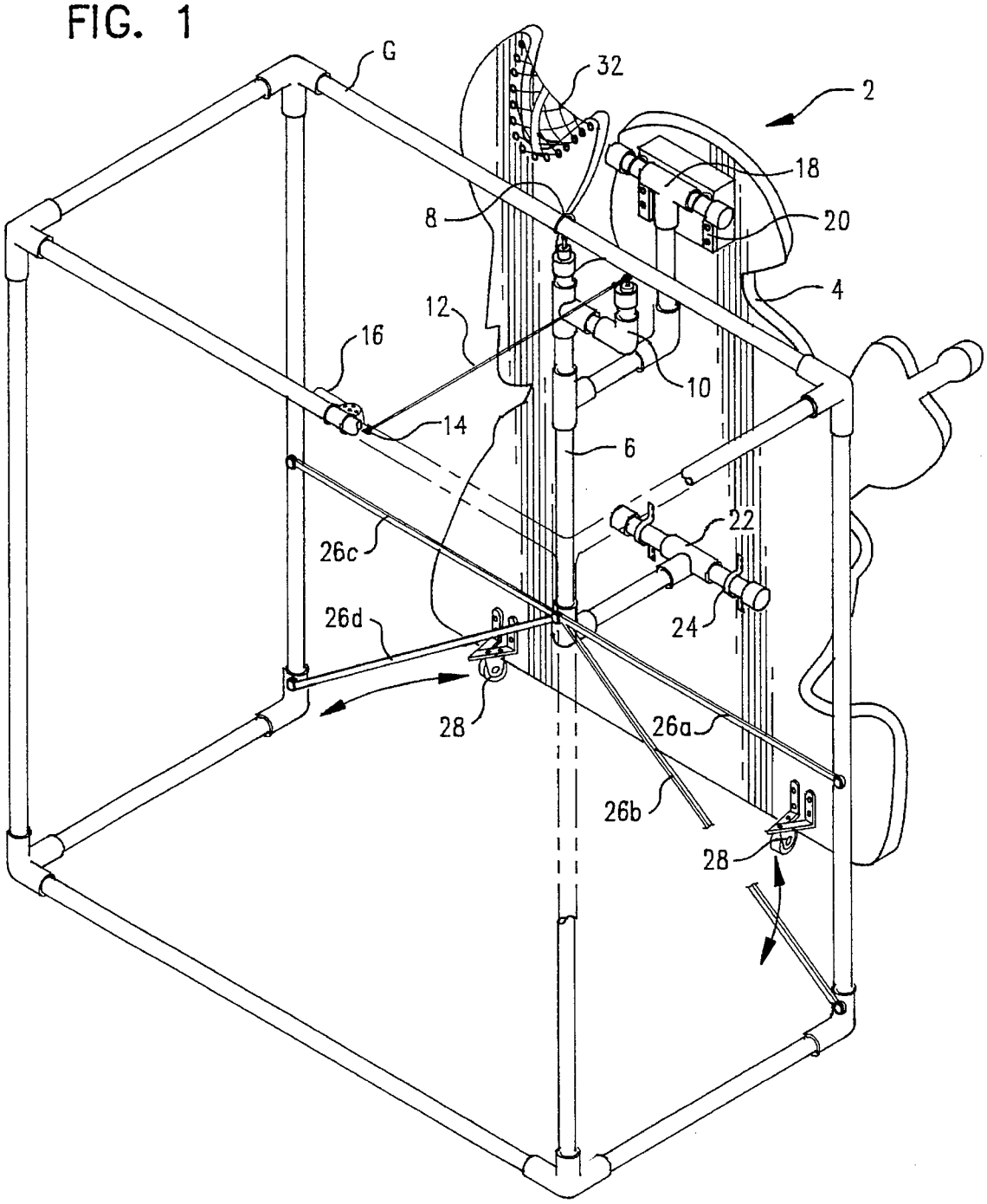
FIG. 1 is a perspective view shown from the rear of the goal tender apparatus of the present invention attached to an exemplary goal.
Figure 2:
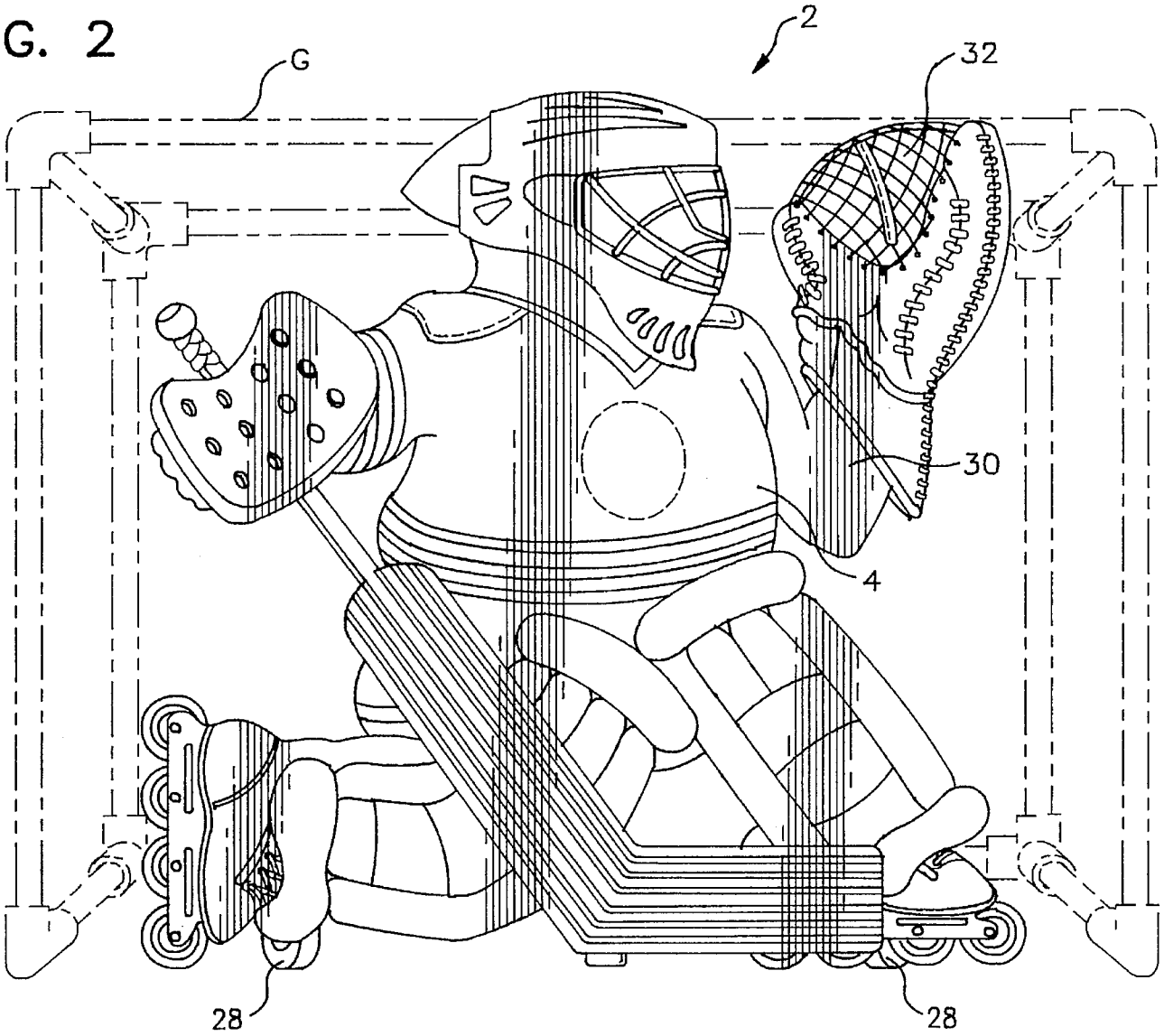
FIG. 2 is a perspective view shown from the front of the goal tender apparatus of the present invention attached to an exemplary goal.

Referring to FIGS. 1 and 2, goal tender apparatus 2 includes goal tender body 4 which is a substantially planar member configured to resemble a human goal tender in a goal-saving configuration. Longitudinal shaft 6 has upper attachment hook 8 located at the top end thereof. Upper attachment hook 8 pivotally connects goal tender body 4 onto the upper crossbar of goal G, and allows convenient removal of goal tender apparatus 2 from goal G. Attached to longitudinal shaft 6 immediately below upper attachment hook 8 is motor shaft attachment arm 10, which is preferably an L-shaped arm which is preferably substantially perpendicular to longitudinal shaft 6 and attaches to an end of motor shaft 12. The other end of motor shaft 12 is attached to an outer edge of cam 14. Cam 14 is rotatably connected to motor 16 such that actuation of motor 16, which can be, for example, an electrical 12 volt motor of the type employed in automobile windshield wipers, causes rotation of cam 14 which, in turn, causes reciprocation of motor shaft 12 along its longitudinal axis and in a plane substantially parallel to both motor shaft attachment arm 10 and longitudinal shaft 6. It should be noted that motor 16 can cause cam 14 to rotate clockwise, counterclockwise, and/or intermittently in both the counterclockwise and clockwise directions. Motor 16 is preferably attached to one of the crossbars or side posts of goal G.

Underneath motor shaft attachment arm 10 on longitudinal shaft 6 is top T-brace 18 which provides one of the points of attachment between goal tender body 4 and longitudinal shaft 6 by means of brackets 20. Below top T-brace 18 on longitudinal shaft 6 is bottom T-brace 22, which provides another point of attachment between goal tender body 4 and longitudinal shaft 6 by brackets 24. It should be noted that longitudinal shaft 6, motor shaft attachment arm 10, top T-brace 18 and bottom T-brace 22 are all comprised of PVC piping, but may also be comprised of other suitable polymeric, metallic, or wooden material readily known in the art.

Figure 6:
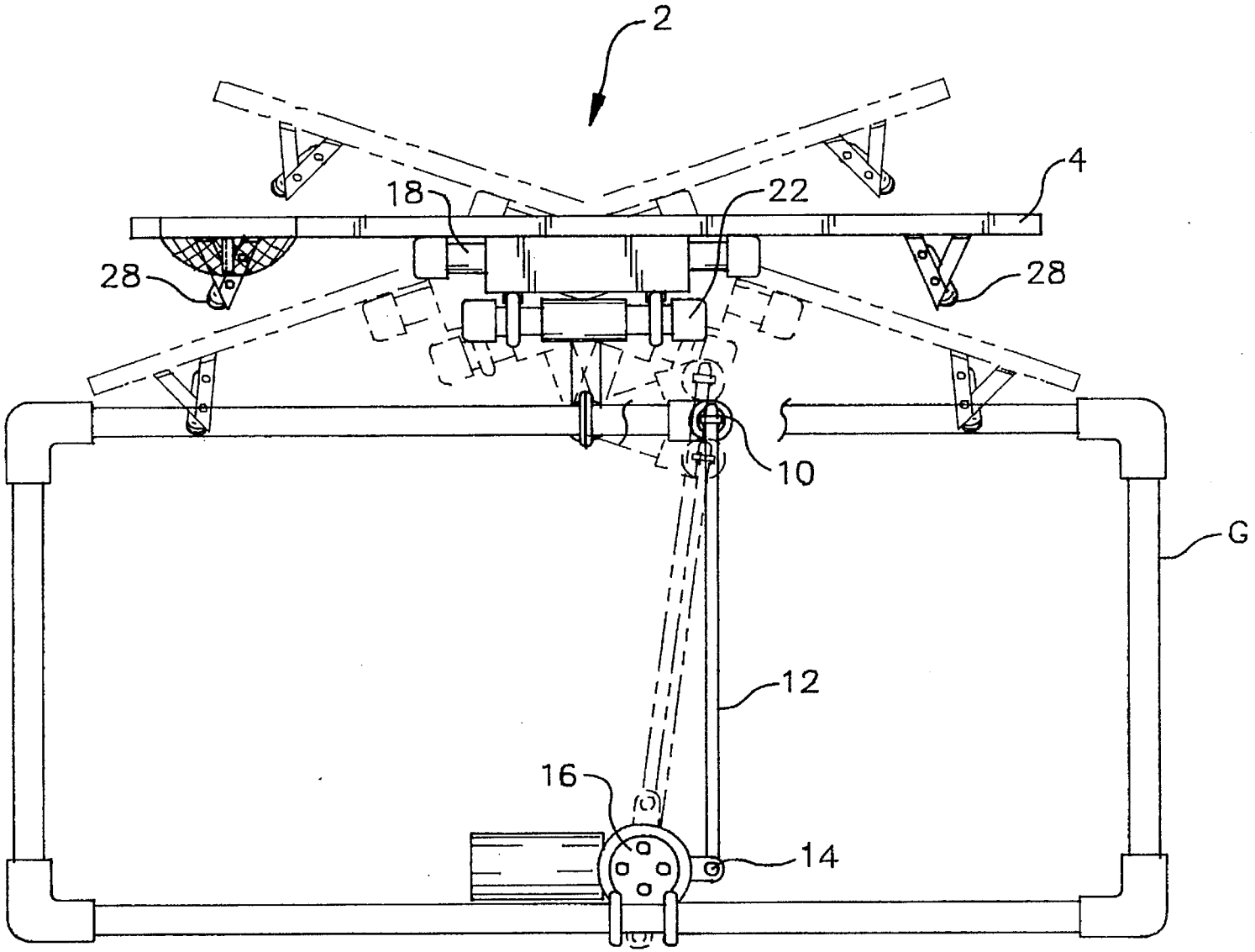
FIG. 6 is a top view of the goal tender apparatus of the present invention in operation, showing the various arcuate positions of the goal tender body with respect to the exemplary goal.

Attached adjacent to the bottom end of longitudinal shaft 6 in proximity to the attachment point of bottom T-brace 22 with longitudinal shaft 6 are lower attachment elastomers 26*a*, 26*b*, 26*c* and 26*d*. Lower attachment elastomers 26*a*, 26*b*, 26*c* and 26*d* are also removably attached to the side posts of goal G as shown in FIG. 1. Lower attachment elastomers 26*a*, 26*b*, 26*c* and 26*d* provide self centering pivoting movement of goal tender body 4 based on the resistive force in these elastomers against which motor 16 imparts force through motor shaft 12 and motor shaft attachment arm 10. Lower attachment elastomers 26*a*, 26*b*, 26*c* and 26*d* can be elastomeric members such as bungee cords comprised of natural rubber or synthetic polymer, for example. Additionally, lower attachment elastomers 26*a*, 26*b*, 26*c* and 26*d* can be substituted for rigid attachment members which still allow pivotal motion of goal tender body 4 and longitudinal shaft 6 with respect to these rigid members. Lower attachment elastomers 26*a*, 26*b*, 26*c* and 26*d*, along with upper attachment hook 8, thus provide pivotal movement of goal tender body 4 in an arcuate path in front of goal G in response to the motive force provided by motor 16 through motor shaft 12 and motor shaft attachment arm 10. Thus, lower attachment elastomers 26*a*, 26*b*, 26*c* and 26*d* both provide a pivot point which converts the linear movement of motor shaft 12 into arcuate movement of goal tender body 4 as well as providing resistance on each side of goal tender body 4 to the translated arcuate movement such that goal tender body 4 self centers. The aforesaid linear motion of motor shaft 12 based on rotation of cam 14 of motor 16 that is translated into arcuate motion of goal tender body 4 is best shown in FIG. 6. As shown in both FIG. 1 and FIG. 6, wheels 28 attached at an angle of about 45° to the bottom portion of goal tender body 4 further encourage arcuate travel of goal tender body 4 in the goal mouth of goal G in order to provide realistic goal tender movement.

Referring now to FIG. 2, goal tender body 4 preferably includes an arm 30 having thereon netting 32 spanning an opening in arm 30 such that some puck shots that are successfully defended by goal tender apparatus 2 are realistically caught in netting 32 on arm 30.

Figure 3:
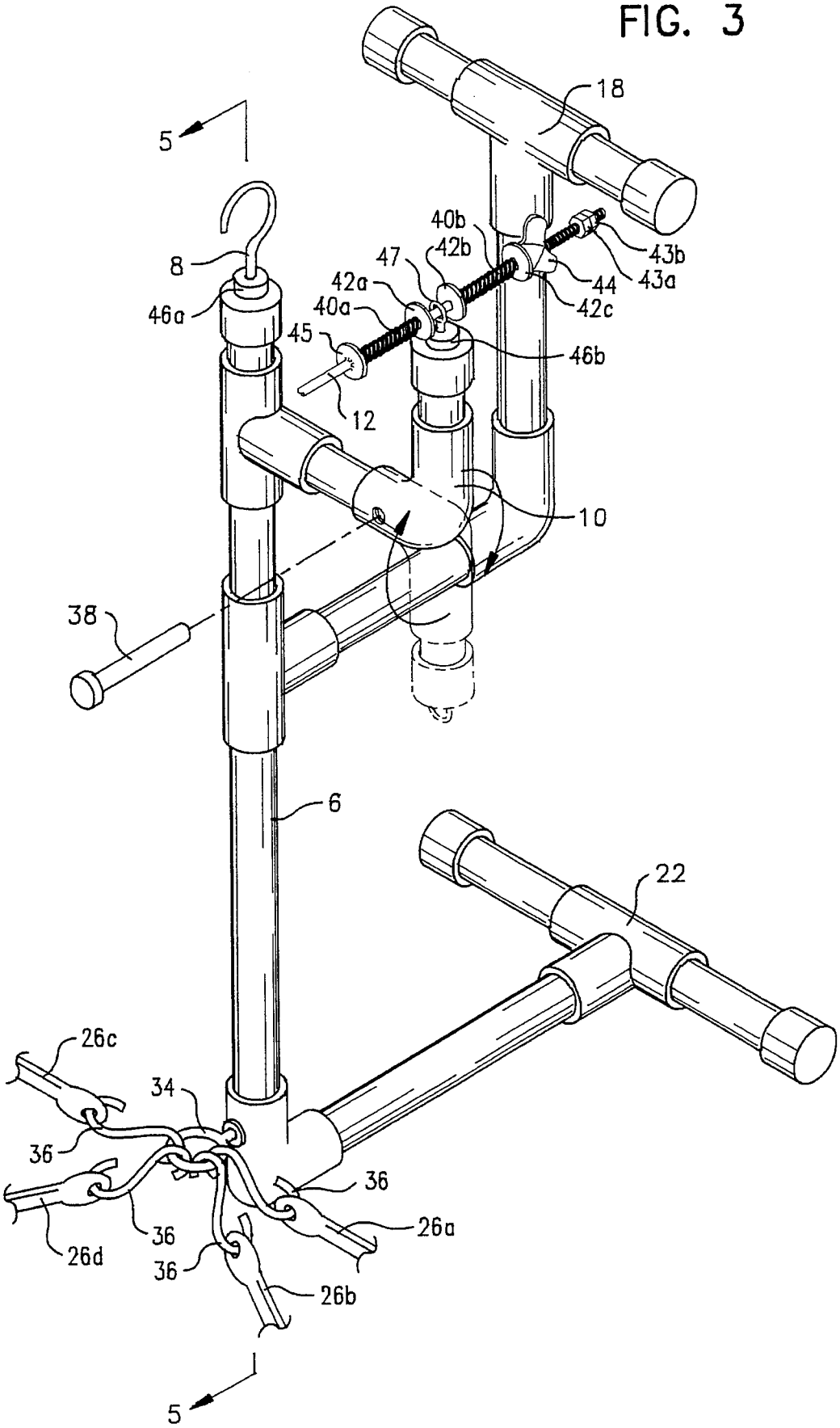
FIG. 3 is a detailed perspective view of the longitudinal shaft and associated T-braces that attach the goal tender body to the exemplary goal.

Referring now to FIG. 3, longitudinal shaft 6, motor shaft attachment arm 10, top T-brace 18 and bottom T-brace 22 are shown in detail. On the bottom end of longitudinal shaft 6, eye-hook 34 is located. Eye-hook 34 removably connects a plurality of S-hooks 36, and each S-hook 36 is connected to one of lower attachment elastomers 26*a*, 26*b*, 26*c* and 26*d* such that eye-hook 34 removably attaches lower attachment elastomers 26*a*, 26*b*, 26*c* and 26*d* to longitudinal shaft 6.

Figure 4:
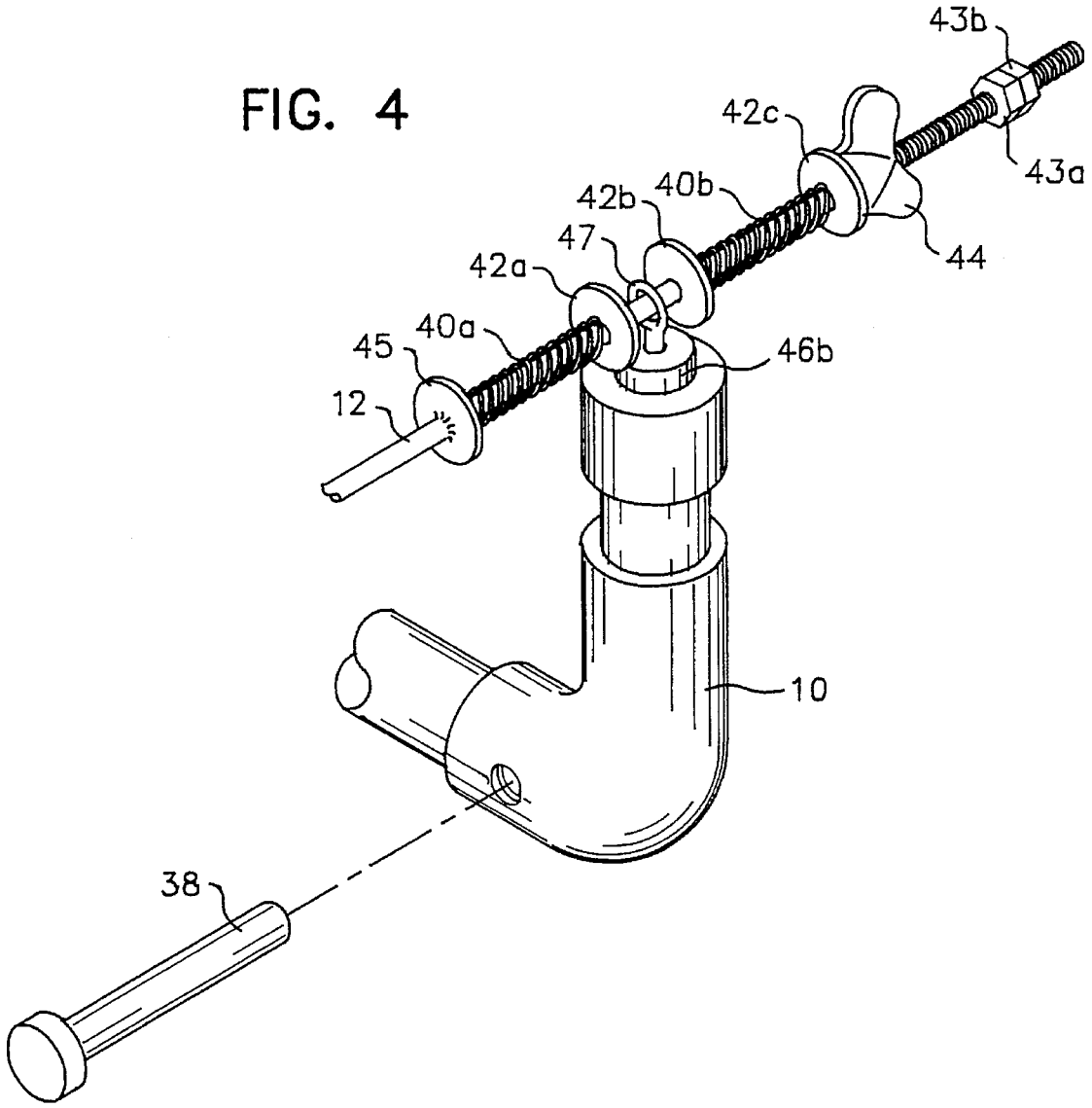
FIG. 4 is a detailed exploded view of the motor shaft that connects the motor and goal tender body.

Still referring to FIG. 3, motor shaft attachment arm 10 is connected to longitudinal shaft 6 by bolt 38. The spatial orientation of motor shaft attachment arm 10 can be altered by pivoting motor shaft attachment arm 10 180° with respect to longitudinal shaft 6 in order to alter the spatial orientation between motor shaft 12 and longitudinal shaft 6. As shown in detail in FIG. 4, shaft 12 has a threaded end with fixed collar 45 and slidable washer 42*a* thereon, in between of which is located spring 40*a*. Similarly, spring 40*b* is located between free washers 42*b* and 42*c*. Wing nut 44 allows tension adjustment of spring 40*b* and 40*a*. Lock nuts 43*a* and 43*b* prevent accidental removal of the above components from shaft 12. Springs 40*a* and 40*b* provide shock absorption of forces from puck shots that impinge upon goal tender body 4. Also, springs 40*a* and 40*b* act as an inertial absorber which extends the life of motor 16 by absorbing energy from motor 16, which runs constantly, that is not transferred to goal tender body 4 when goal tender body 4 intermittently stops travel based on action of cam 14. Shaft 12 passes through eye hook 47 which is secured by bushing 46*b* in attachment arm 10.

Figure 5:
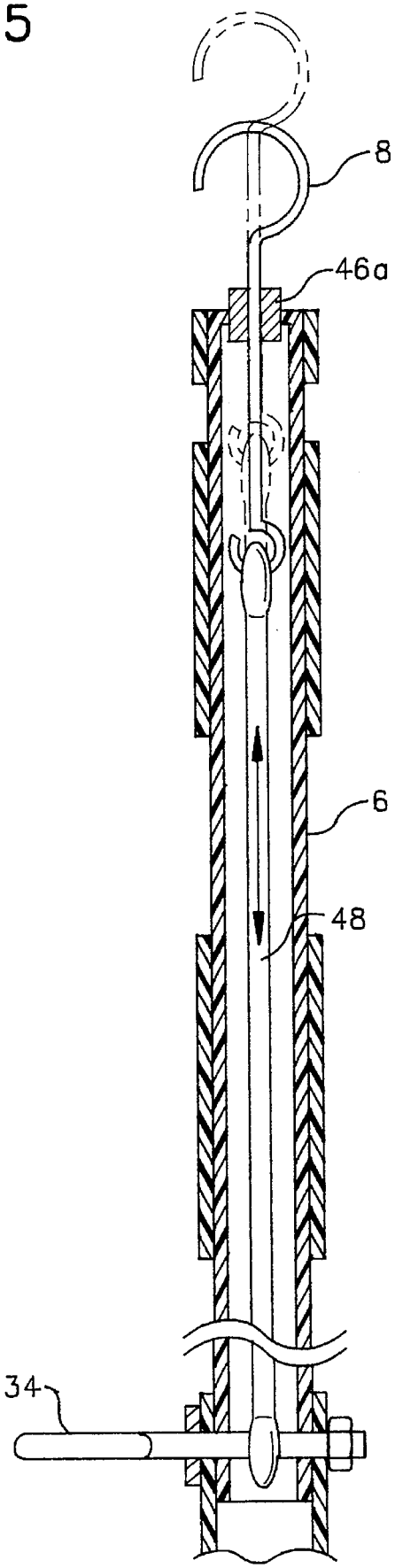
FIG. 5 is an exposed view of the longitudinal shaft that attaches the goal tender body to the exemplary goal.

Referring now to FIG. 5, upper attachment hook 8 is preferably secured to the top of longitudinal shaft 6 with bushing 46*a* therein such that upper attachment hook 8 is reciprocatable through bushing 46*a* and along the longitudinal axis of longitudinal shaft 6. Shaft elastomer 48, comprised of rubber or a synthetic polymer known in the art, is preferably attached between upper attachment hook 8 and eye-hook 34. Reciprocation of upper attachment hook 8 with respect to longitudinal shaft 6, and attachment between upper attachment hook 8 and eye-hook 34 by shaft elastomer 48 allows the goal tender apparatus 2 of the present invention to be employed with goals of different heights while ensuring that wheels 28 contact the ground in order for arcuate movement of goal tender body 4 to occur while maintaining pivoting contact between upper attachment 8 and the crossbar of goal G. Therefore, if a goal tender apparatus 2 is to be attached to a goal G having a relatively larger height, upper attachment hook 8 will move outwardly with respect to longitudinal shaft 6 in order to increase the effective height of the combination of upper attachment hook 8 and longitudinal shaft 6. Likewise, if a goal G having a lesser height is employed, upper attachment hook 8 will move toward longitudinal shaft 6 to decrease the effective height of the combination of upper attachment hook 8 and longitudinal shaft 6. The elastomeric force of shaft elastomer 48 can be predetermined such that a portion of the mass of goal tender body 4 is offset by the elastomeric force from shaft elastomer 48 to decrease the mass of goal tender body 4 such that the frictional forces between wheels 28 and the surface on which wheels 28 slide is decreased. Thus, a motor 16 having a lesser horsepower can be employed in the present invention in order to save energy and decrease production costs while still maintaining sufficient motor power to provide quick, precise, accurate and responsive movement of goal tender body 4.

While particular embodiments of the present invention have been described in some detail herein above, changes and modifications may be made in the illustrated embodiments without departing from the spirit of the invention.

I claim:

1. A goal tender apparatus comprising:

a goal tender body having a longitudinal axis with an upper portion and a lower portion, said goal tender body having a lower end;

upper attachment means pivotally attaching said goal tender body to an upper crossbar of a goal adjacent said upper portion of said longitudinal axis of said goal tender body;

lower attachment means pivotally attaching said goal tender body to side posts of a goal adjacent said lower portion of said longitudinal axis of said goal tender body;

roller means on said lower end of said goal tender body; and motor means providing a force substantially perpendicular to said longitudinal axis of said goal tender body, said upper attachment means, said lower attachment means and said roller means converting the substantially perpendicular force of said motor means into arcuate movement of said goal tender body in front of a goal.

2. The goal tender apparatus of claim 1 wherein said longitudinal axis is defined by a longitudinal shaft attached to said goal tender body.

3. The goal tender apparatus of claim 2 wherein said upper attachment means comprises:

a hook on an upper end of said longitudinal shaft, said hook adapted to be removably attached to an upper crossbar of a goal, said hook being reciprocatable with respect to said longitudinal shaft such that said goal tender body is attachable to goals of different heights;

a motor shaft attachment arm connected to and substantially perpendicular to said longitudinal shaft;

an elastomer attachment means on a lower end of said longitudinal shaft; and an elastomer connected to said hook and said elastomer attachment means such that a portion of the mass of said goal tender body is offset by force from said elastomer to decrease the frictional forces associated with said goal tender body that said motor means must overcome.

4. The goal tender apparatus of claim 1 wherein said lower attachment means comprises a plurality of elastomers connected between said lower portion of said longitudinal axis of said goal tender body and side posts of a goal to provide self centering resistance to the arcuate movement imparted to said goal tender body by said motor means.

5. The goal tender apparatus of claim 1 wherein said motor means comprises:

a motor;

a cam rotatable by said motor; and a shaft having a first end attached to said cam and a second end attached to said upper portion of said longitudinal axis of said goal tender body.

6. The goal tender apparatus of claim 1 wherein said goal tender body has an arm portion with netting on an end thereof.

7. A goal tender apparatus comprising:

a goal tender body having a longitudinal shaft thereon with an upper portion and a lower portion, said goal tender body having a lower end;

upper attachment means pivotally attaching said goal tender body to an upper crossbar of a goal adjacent said upper portion of said longitudinal shaft of said goal tender body, said upper attachment means comprising a hook on an upper end of said longitudinal shaft, said hook adapted to be removably attached to an upper crossbar of a goal, said hook being reciprocatable with respect to said longitudinal shaft such that said goal tender body is attachable to goals of different heights, a motor shaft attachment arm connected to and substantially perpendicular to said longitudinal shaft, an elastomer attachment means on a lower end of said longitudinal shaft, and an elastomer connected to said hook and said elastomer attachment means such that a portion of the mass of said goal tender body is offset by force from said elastomer to decrease frictional forces associated with said goal tender body that must be overcome;

lower attachment means pivotally attaching said goal tender body to side posts of a goal adjacent said lower portion of said longitudinal shaft of said goal tender body;

roller means on said lower end of said goal tender body; and motor means providing a force substantially perpendicular to said longitudinal axis of said goal tender body, said upper attachment means, said lower attachment means and said roller means converting the substantially perpendicular force of said motor means into arcuate movement of said goal tender body in front of a goal.

8. The goal tender apparatus of claim 7 wherein said lower attachment means comprises a plurality of elastomers connected between said lower portion of said longitudinal shaft of said goal tender body and side posts of a goal to provide self centering resistance to the arcuate movement imparted to said goal tender body by said motor means.

9. The goal tender apparatus of claim 7 wherein said motor means comprises:

a motor;

a cam rotatable by said motor; and a shaft having a first end attached to said cam and a second end attached to said upper portion of said longitudinal shaft of said goal tender body.

10. The goal tender apparatus of claim 7 wherein said goal tender body has an arm portion with netting on an end thereof.

11. A goal tender apparatus comprising:

a goal tender body having a longitudinal axis with an upper portion and a lower portion, said goal tender body having a lower end;

upper attachment means pivotally attaching said goal tender body to an upper crossbar of a goal adjacent said upper portion of said longitudinal axis of said goal tender body;

lower attachment means pivotally attaching said goal tender body to side posts of a goal adjacent said lower portion of said longitudinal axis of said goal tender body, said lower attachment means comprising a plurality of elastomers connected between said lower portion of said longitudinal axis of said goal tender body and side posts of a goal to provide self centering resistance to the arcuate movement imparted to said goal tender body;

roller means on said lower end of said goal tender body; and motor means providing a force substantially perpendicular to said longitudinal axis of said goal tender body, said upper attachment means, said lower attachment means and said roller means converting the substantially perpendicular force of said motor means into arcuate movement of said goal tender body in front of a goal.

12. The goal tender apparatus of claim 11 wherein said longitudinal axis is defined by a longitudinal shaft attached to said goal tender body.

13. The goal tender apparatus of claim 12 wherein said upper attachment means comprises:

a hook on an upper end of said longitudinal shaft, said hook adapted to be removably attached to an upper crossbar of a goal, said hook being reciprocatable with respect to said longitudinal shaft such that said goal tender body is attachable to goals of different heights;

a motor shaft attachment arm connected to and substantially perpendicular to said longitudinal shaft;

an elastomer attachment means on a lower end of said longitudinal shaft; and an elastomer connected to said hook and said elastomer attachment means such that a portion of the mass of said goal tender body is offset by force from said elastomer to decrease frictional forces associated with said goal tender body that said motor means must overcome.

14. The goal tender apparatus of claim 11 wherein said motor means comprises:

a motor;

a cam rotatable by said motor; and a shaft having a first end attached to said cam and a second end attached to said upper portion of said longitudinal axis of said goal tender body.

15. The goal tender apparatus of claim 11 wherein said goal tender body has an arm portion with netting on an end thereof.

* * * * *